US005832889A

United States Patent [19]

Naruoka et al.

[11] Patent Number: 5,832,889

[45] Date of Patent: Nov. 10, 1998

[54] VALVE DRIVING APPARATUS

[75] Inventors: Takao Naruoka; Takehisa Yaegashi, both of Mishima, Japan

[73] Assignee: Toyota Jidosha Kabushiki Kaisha, Aichi-ken, Japan

[21] Appl. No.: 854,514

[22] Filed: May 12, 1997

[30] Foreign Application Priority Data

May 13, 1996 [JP] Japan ..... 8-117996
Mar. 11, 1997 [JP] Japan ..... 9-056345

[51] Int. Cl.[6] ..... F01L 1/12; F01L 13/00

[52] U.S. Cl. ..... 123/90.18; 123/90.48; 123/90.39

[58] Field of Search ..... 123/90.15, 90.16, 123/90.17, 90.18, 90.27, 90.48, 90.52, 90.39, 90.45; 251/251

[56] References Cited

U.S. PATENT DOCUMENTS

| | | | |
|---|---|---|---|
| 3,023,870 | 3/1962 | Udelman | 123/90.18 |
| 3,915,129 | 10/1975 | Rust et al. | 123/90.18 |
| 4,850,311 | 7/1989 | Sohn | 123/90.18 |
| 5,094,197 | 3/1992 | Rosa | 123/90.17 |
| 5,159,906 | 11/1992 | Fontichiaro et al. | 123/90.18 |
| 5,367,991 | 11/1994 | Asai et al. | 123/90.18 |
| 5,381,764 | 1/1995 | Fukuma et al. | 123/90.18 |
| 5,570,665 | 11/1996 | Regueiro | 123/90.27 |
| 5,606,942 | 3/1997 | Tsuzuku et al. | 123/90.28 |

FOREIGN PATENT DOCUMENTS

| | | |
|---|---|---|
| WO8706647 | 11/1987 | European Pat. Off. . |
| 512698 | 11/1992 | European Pat. Off. . |
| 58-63304 | 4/1983 | Japan . |
| 59-90711 | 5/1984 | Japan . |
| 3-42001 | 4/1991 | Japan . |
| 3-179116 | 8/1991 | Japan . |
| 4-12104 | 1/1992 | Japan . |
| 7-279631 | 10/1995 | Japan . |

*Primary Examiner*—Weilun Lo
*Attorney, Agent, or Firm*—Kenyon & Kenyon

[57] ABSTRACT

A valve driving apparatus includes a cam, a force transfer member transferring force of the cam to a valve, and a shim interposed between the cam and the force transfer member and movable on the force transfer member. The shim has a first portion, a part of which first portion is always in contact with the force transfer member while the shim is being moved on the force transfer member in accordance with a motion of the cam.

10 Claims, 6 Drawing Sheets

VALVE DRIVING APPARATUS

BACKGROUND OF THE INVENTION

1. Field of the Invention

The present invention generally relates to a valve driving apparatus, and more particularly to a valve driving apparatus suitable for an internal combustion engine. More specifically, the present invention is concerned with a valve driving apparatus having a structure in which a shim is interposed between a three-dimensional cam and a lifter.

2. Description of the Related Art

A variable valve mechanism is known which changes the timing at which a valve is driven and the amount of lift of the valve in accordance with the working conditions (the revolution, load and so on) of an internal combustion engine. Such a variable valve mechanism makes it possible to improve the power and fuel economy of the engine and reduce exhaust emission.

A conventional valve driving apparatus having the above variable valve mechanism has a three-dimensional cam, which includes a cam part having a slant surface which is inclined toward a shaft of the cam part. The three-dimensional cam is movable in the direction in which the cam shaft extends. The amount of the movement of the three-dimensional cam is controlled so that the valve driving timing and amount of valve lift can be optimized.

FIG. 1 discloses a valve driving apparatus as described above. Such a valve driving apparatus is disclosed in, for example, Japanese Unexamined Utility Model Publication No. 3-42001. A valve driving apparatus 1 shown in FIG. 1 includes a three-dimensional cam 2, a valve 3, a lifter 4 and a shim 5.

The three-dimensional cam 2 is made up of a cam part 6 and a cam shaft 7. The cam part 6 has a slant surface 8 that slants toward the cam shaft of the cam part 6. In FIG. 1, a symbol $\alpha$ denotes a slant angle. The three-dimensional cam 2 can be moved in directions X1 and X2 by means of an actuator (not shown).

A valve 3 is provided to an air intake port or exhaust port provided in a cylinder head 10 of the engine. The valve 3 is moved up or down in accordance with the rotating operation of the three-dimensional cam 2. Hence, the air intake port or exhaust port can be opened and closed. A retainer 9 is provided at an upper portion of the valve 3 and is urged upwardly by means of an elastic urging force provided by a valve spring 14. Hence, the valve 3 is always urged upwardly due to the valve spring 14. In FIG. 1, Z1 is defined as an upper direction and Z2 is defined as a lower direction.

The lifter 4 is provided to the upper portion of the valve 3, and has a top surface which forms a spherical projection portion 11. The lifter 4 functions to transfer the driving power of the three-dimensional cam 2 to the valve 3. The lifter 4 is moved up and down and is guided by a lifter hole 10*a* formed in the cylinder head 10.

The shim 5 is interposed between the three-dimensional cam 2 and the lifter 4, and has a flat surface portion 12 located at an upper portion of the shim 5. The flat surface portion 12 of the shim 5 is in contact with the three-dimensional cam 2. Further, the shim 5 has a spherical recess portion 13 at a lower portion thereof. The spherical recess portion 13 engages with the spherical projection portion 11 formed in the lifter 4. The spherical projection portion 11 and the spherical recess portion 13 have an identical curvature. Hence, the shim 5 can be rotatably moved along the spherical projection portion 11 formed in the lifter 4.

In the above structure, when the cam shaft 7 is moved in the direction X1 or X2 by the actuator (not shown), the valve driving timing and the amount of valve lift can be varied because the three-dimensional cam 2 has the slant surface 8 which is inclined towards the cam shaft. The shim 5 is rotatably moved on the lifter 5 in accordance with the motion of the three-dimensional cam 2. Hence, a large contact area between the lifter 4 and the shim 5 can be ensured and maintained even when the three-dimensional cam 2 is moved. Hence, the abrasion resistance can be improved.

It should be noted that the shim 5 is allowed to rotatably move on the lifter 4 in free fashion because the shim 5 can be rotatably moved on the lifter 4 and the three-dimensional cam 2 can move in the directions X1 and X2. Further, the valve driving apparatus 1 is not equipped with any means for urging the shim 5 in a given direction. This allows the shim 5 to freely move on the lifter 4.

Particularly, when the cam 2 enters a lifting phase of the operation, the motion of the shim 5 is restricted by the cam 2 and the lifter 4 due to a spring force proportional to the amount of lift of the cam 2. However, the shim 5 may be rotatably moved along the spherical shape of the lifter 4 due to a movement of the contact between the cam 2 and the shim 5 caused by lifting or a movement of the contact between the slant surface 8 of the cam 2 and the shim 5 due to the three-dimensional structure of the cam 2. Such an unwanted rotational movement of the shim 5 will occur if only a small spring constant is available or at the commencement of the lifting in which only a small spring force is available.

If the shim 5 moves from the position indicated by the solid line shown in FIG. 1 to another position indicated by the one-dot chained line, the shim 5 hits the cylinder head 10, and thus an impact sound (noise) occurs.

In practice, a plurality of valves 3 are provided for each cylinder of the engine and are moved up and down at a very high speed. Hence, the valves 3 hit the respective cylinder heads 10, and an extremely large noise occurs as a result of the whole operation of the engine.

SUMMARY OF THE INVENTION

It is a general object of the present invention to provide a valve driving apparatus suitable for an internal combustion engine in which the above disadvantages are eliminated.

A more specific object of the present invention is to provide a valve driving apparatus suitable for an internal combustion engine in which an occurrence of impact noise is significantly reduced.

The above objects of the present invention are achieved by a valve driving apparatus comprising:

cam; a force transfer member transferring force of the cam to a valve; and a shim interposed between the cam and the force transfer member and movable on the force transfer member. The shim has a first portion, a part of which first portion is always in contact with the force transfer member while the shim is being moved on the force transfer member according to a motion of the cam.

The valve driving apparatus may be configured so that the force transfer member has a second portion, a part of which second portion is always in contact with the first portion of the shim while the shim is being moved on the force transfer member.

The valve driving apparatus may be configured so that: the shim has a spherical projection portion; and the force transfer member has a spherical recess portion which engages with the spherical projection portion.

The valve driving apparatus may be configured so that the shim has a flat surface portion which is in contact with the cam.

The valve driving apparatus may be configured so that the cam has a center which deviates from an axis of the force transfer member.

The valve driving apparatus may be configured so that the center of the cam deviates from the axis of the force transfer member towards an upstream side in a rotational direction of the cam with respect to a position at which the cam is in contact with the shim.

The valve driving apparatus may further comprise a shim urging mechanism which urges the shim so that the first portion of the shim is always in contact with the force transfer member while the shim is being moved on the force transfer member according to the motion of the cam.

The valve driving apparatus may be configured so that: the shim has a spherical recess portion; and the force transfer member has a spherical projection portion which engages with the spherical recess portion.

The valve driving apparatus may be configured so that the cam has a center which deviates from an axis of the force transfer member.

The valve driving apparatus may be configured so that the valve is provided in an internal combustion engine.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
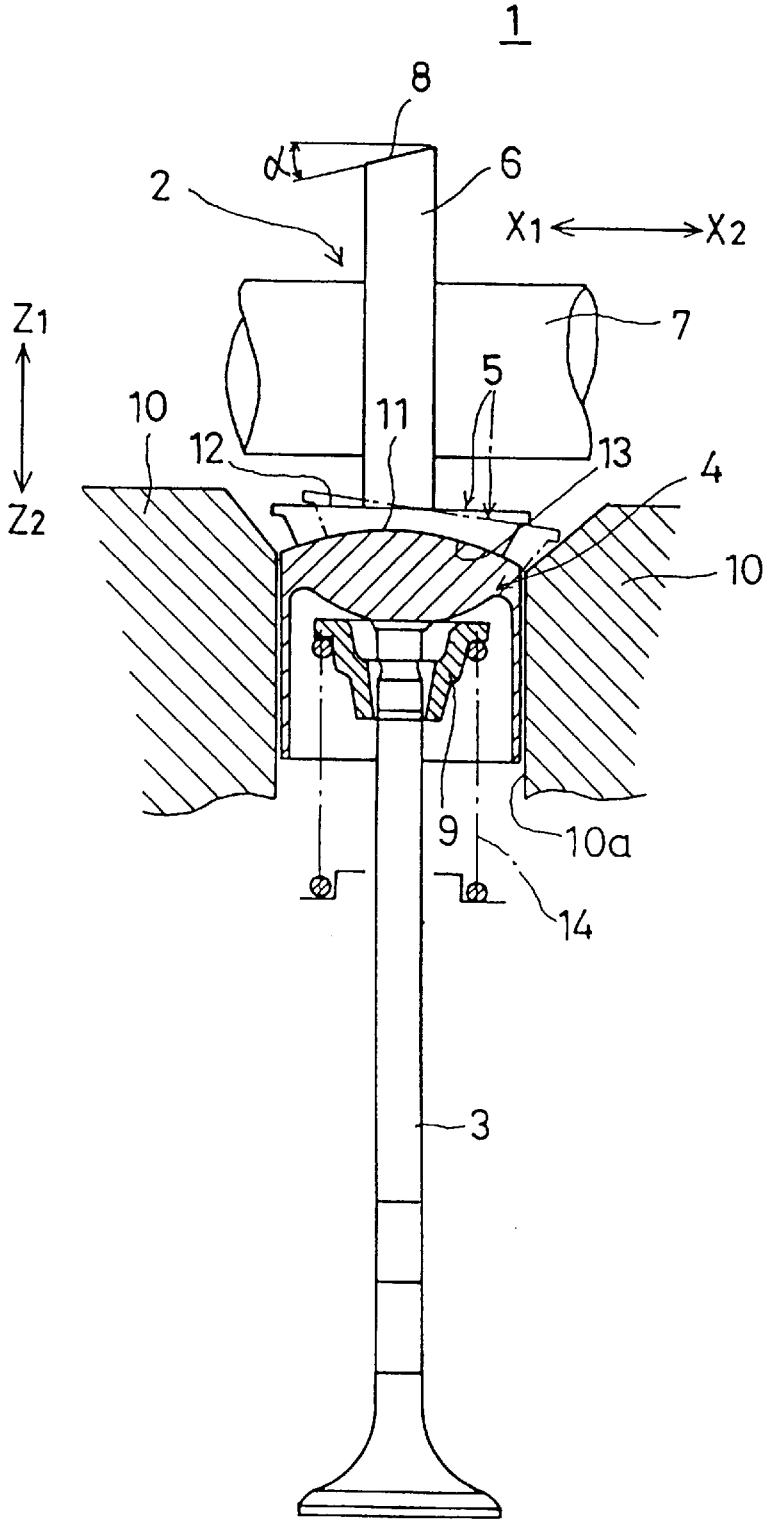
FIG. 1 PRIOR ART
FIG. 1 is a partial cross-sectional side view of a conventional valve driving apparatus of an internal combustion engine.
Figure 2:
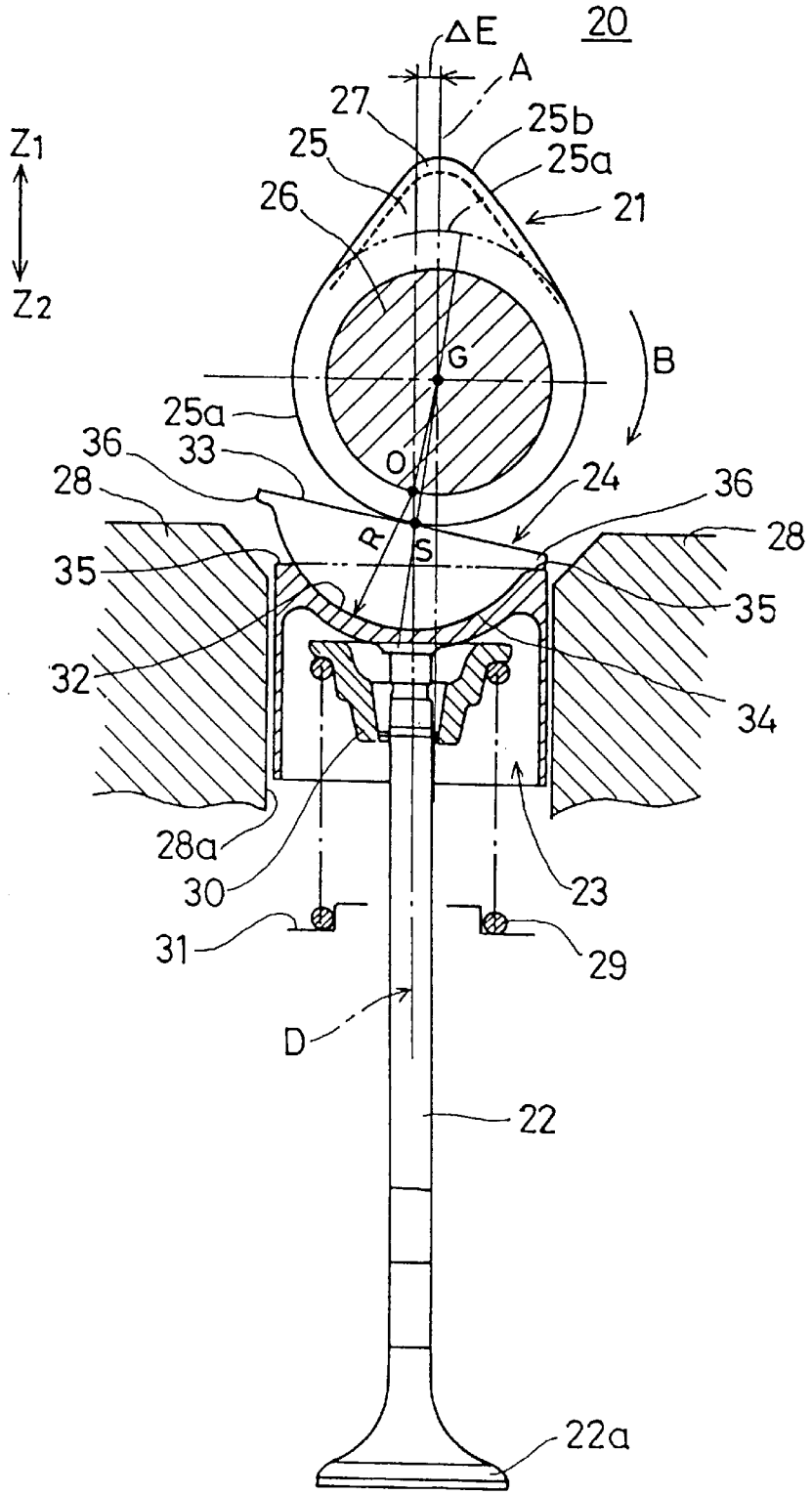
FIG. 2 is a partial cross-sectional side view of a valve driving apparatus according to a first embodiment of the present invention.

FIG. 2 is a partial cross-sectional side view of a valve driving apparatus 20 of an internal combustion engine according to a first embodiment of the present invention. The valve driving apparatus 20 is of a direct moving or overhead cam type. The valve driving apparatus 20 is mainly made up of a three-dimensional cam 21, a valve 22, a lifter 23 and a shim 24.

The three-dimensional cam 21 is composed of a cam part 25 and a cam shaft 26. The cam part 25 has a slant surface 27 (which clearly appears in part (C) of FIG. 4) formed on a cam lobe 25*b*, which projects from a circular base 25*a*. The cam shaft 26 is coupled with a crank shaft of the engine by means of a timing gear and a timing belt, and is rotated in synchronism with the rotation of the crank shaft.

An actuator (not shown) is provided to an end portion of the cam shaft 26. The three-dimensional cam 21 can be moved in the cam shaft directions, that is, the directions X1 and X2 (shown in part (A) of FIG. 4). A symbol "G" shown in the figures denotes the center of the cam shaft 26, which will be referred to as a cam shaft center G.

The valve 22 opens and closes an air intake port or an exhaust port provided in a cylinder head 28 of the engine. The valve 22 is moved up and down, i.e., reciprocated, while it is contacted by the cam part 25 in accordance with a rotation of the three-dimensional cam 21. A valve head (seat) 22*a* formed at a lower end of the valve 22 opens and closes the air intake port or exhaust port. The arrow Z1 indicates the up or closed direction and the arrow Z2 indicates the down or open direction.

A retainer 30, which retains a valve spring 29, is coupled to the upper portion of the valve 22. The retainer 30 is in contact with the upper portion of the valve spring 29. The lower portion of the valve spring 29 is in contact with the cylinder head 28 via a valve sheet 31. The valve spring 29 elastically urges the valve 22 in the direction Z1 via the retainer 30. Hence, the valve 22 is always urged upwardly by the valve spring 29 so that the valve 22 closes the intake or exhaust port with which it is associated.

The lifter 23 is a cylindrically shaped member having a bottom, and is provided to the upper portion of the valve 22. The lifter 23 has a top surface 32, which has a concave hemispherical shape. In the following description, the lifter top surface 32 is also referred to as a spherical recess portion 32. The lifter 23 functions as a force transferring member, which transfers the force of the three-dimensional cam 21 to the valve 22. The lifter 23 is guided by a valve hole or guide opening 28*a* formed in the cylinder head 28 and is thus moved up and down or reciprocated in the guide opening 28*a*.

The shim 24 is interposed between the three-dimensional cam 21 and the lifter 23, and has a flat surface portion 33 which is located on an upper portion of the shim 24 and is in contact with the three-dimensional cam 21. The shim 24 has a lower spherical projection portion 34, which engages the spherical recess portion 32 formed in the lifter 23. That is, the spherical recess portion 32 and the spherical projection portion 34 have spherical surfaces each having a radius R and having a common center point 0. Hence, the spherical projection portion 34 of the shim 24 is allowed to smoothly move along the spherical recess portion 32 formed in the lifter 23.

An extension portion 35 is formed in an upper end portion of the spherical recess portion 32 of the lifter 23, and slightly extends outwardly. A flange portion 36 is formed on a circumferential portion of a flat surface portion 33 located on the upper portion of the shim 24. A part of the flange portion 36 is constantly in contact with the extension portion 35 formed in the lifter 23, as will be described in detail later.

A description will now be given of a positional relationship among the three-dimensional cam 21, the lifter 23 and the shim 24.

The following terms and condition will now be defined. A cam vertical line A is defined which passes through the cam shaft center G. A contact position S is defined in which the three-dimensional cam 21 and the shim 24 are in contact with each other. The three-dimensional cam 21 is rotated in the direction indicated by an arrow B.

The valve 22 and the lifter 23 have the following positional relationship. The central axis of the valve 22 and the central axis of the lifter 23 coincide with each other so that the pushing force of the three-dimensional cam 21 can be efficiently transferred to the valve 22. The central axes of the valve 22 and the lifter 23 will now be referred to as a lifter axis D, which is indicated by a symbol "D" in FIG. 2.

The three-dimensional cam 21 and the lifter axis D have the following positional relationship. The cam vertical line A passing through the cam shaft center G of the three-dimensional cam 21 and the lifter axis D are offset by $_{\Delta}E$ in the rotational direction B of the three-dimensional cam 21. More particularly, the cam vertical line A passing through the cam shaft center G of the three-dimensional cam 21 is disposed so as to deviate, towards the upstream side in the rotational direction B of the three-dimensional cam 21, from the lifter axis D by $_{\Delta}E$.

Next, a description will be given of the operation of the valve driving apparatus 20 with reference to FIGS. 3 and 4 in addition to FIG. 2.

Figures 3A, 3B, 3C, 3D, 3E, 3F, 3G:
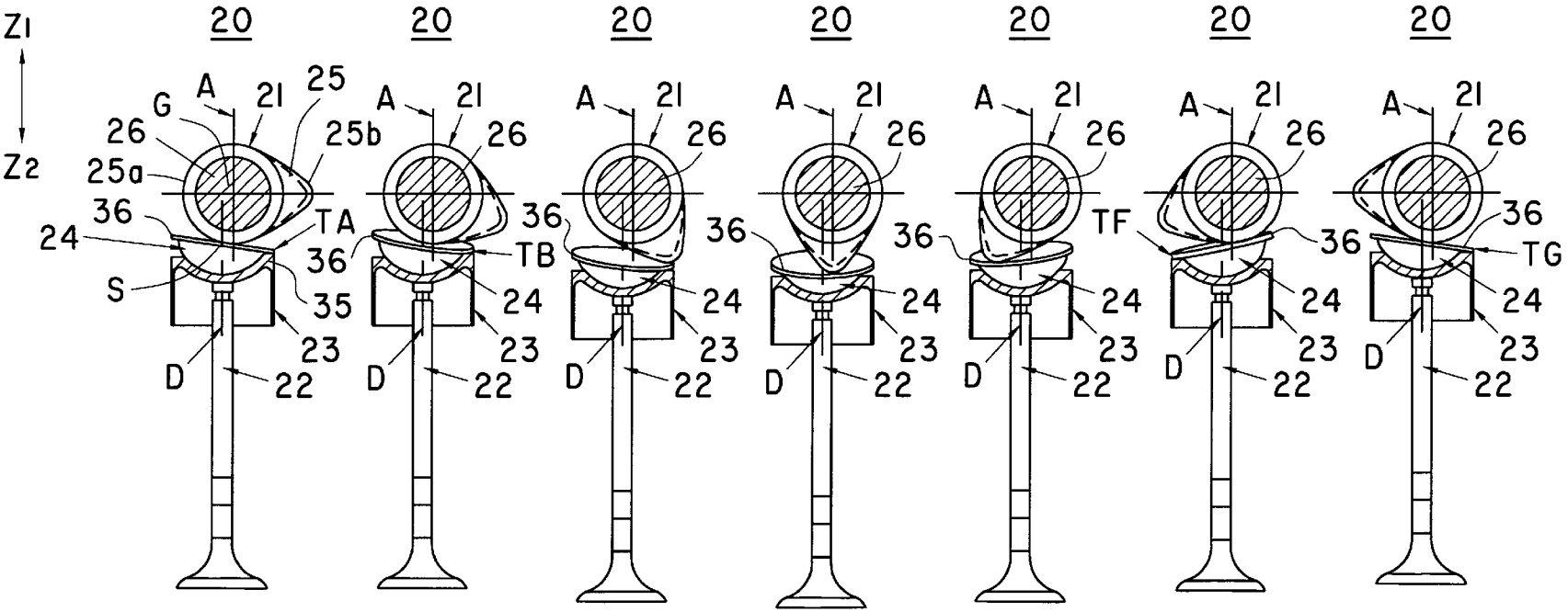
FIGS. 3A–3G and 4A–4G are diagrams showing an operation of the valve driving apparatus shown in FIG. 2.
Figures 4A, 4B, 4C, 4D, 4E, 4F, 4G:
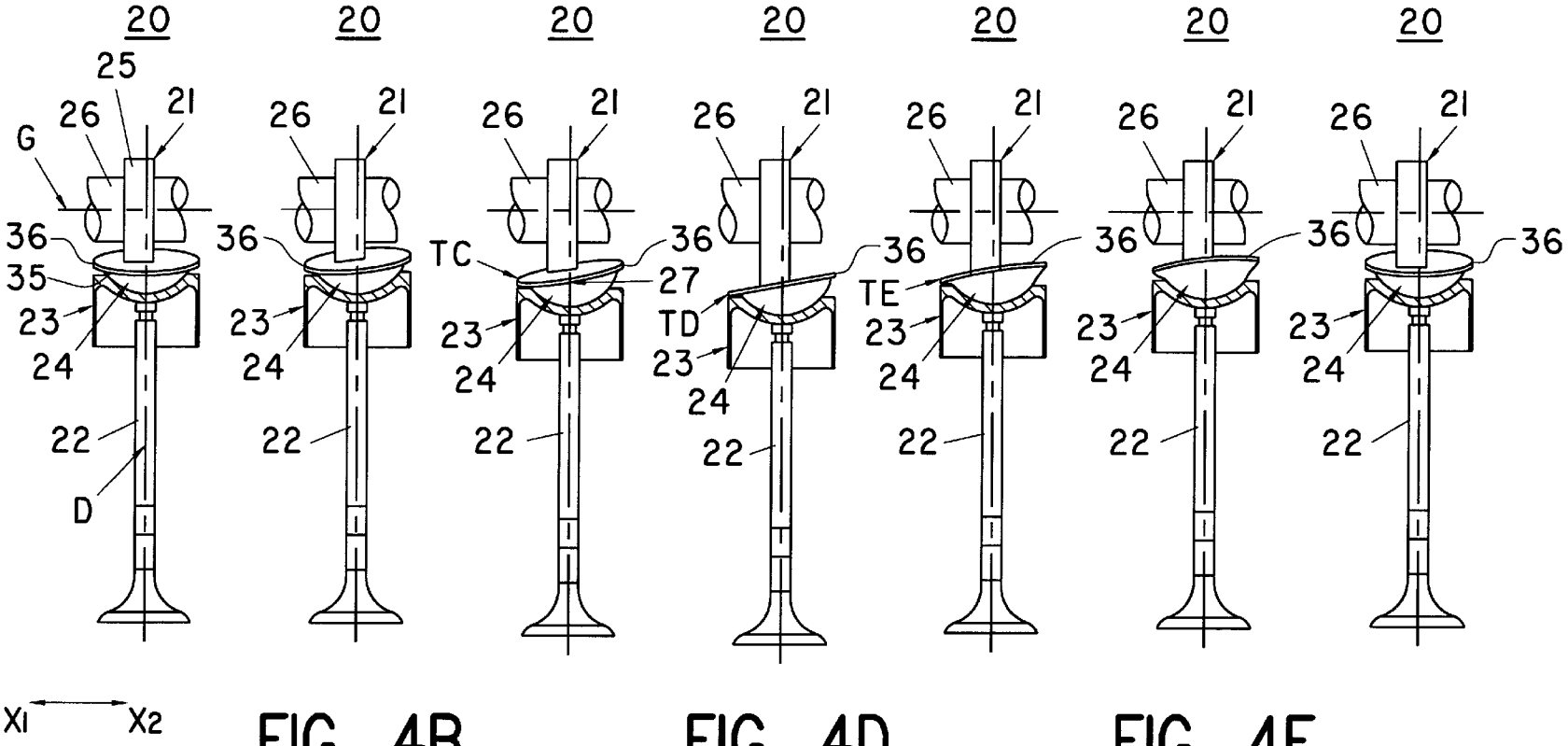

FIGS. 3 and 4 respectively show operations of the valve driving apparatus 20 in which the cam lobe 25*b* of the three-dimensional cam 21 drives the valve 22 in an angle range of approximately equal to 0° to 180°. More particularly, the cam lobe 25*b* starts to move from a right horizontal position shown in parts (A) of FIGS. 3 and 4 and stops in a left horizontal position shown in parts (G) thereof. It should be noted that the lift starting position, the amount of lift and the lift end position depend on the cam profile.

The parts (A) through (G) of FIGS. 3 and 4 show the states of the three-dimensional cam 21 observed every 30°. Further, the parts (A) through (G) of FIG. 3 respectively correspond to the parts (A) through (G) of FIG. 4. In FIGS. 3 and 4, the valve spring 29, the retainer 30 and the valve sheet 31 are omitted for the sake of simplicity.

A basic operation of the valve driving apparatus 20 will be described below. As has been described previously, the three-dimensional cam 21 is rotated in synchronism with the crank shaft. When the three-dimensional cam 21 starts to rotate from the states shown in parts (A) of FIGS. 3 and 4, the cam part 25 pushes the shim 24. A resultant force exerted on the shim 24 is transferred to the lifter 23, which moves the valve 22 down. Hence, the valve 22 starts to be moved in the direction Z2.

As has been described previously, the slant surface 27 is formed on the top surface of the cam part 25 (the top surface of the cam lobe 25*b*), and the spherical projection portion 34 formed in the shim 24 is allowed to freely move along the spherical recess portion 32 formed in the lifter 23. Hence, the slant surface 27 engages with the flat surface portion 33 of the shim 24, the shim 24 is rotated on the lifter 23 in accordance with the slant surface 27, as shown in FIGS. 3 and 4.

As has been described previously, the cam shaft 26 can be moved in the directions X1 and X2 by the actuator (not shown), and the slant surface 27 is formed on the top surface of the cam lobe 25*b*. Hence, when the cam shaft 26 is moved in the direction X1 or X2, the amount of movement of the valve 22 can be controlled.

More particularly, when the cam shaft 26 is moved in the direction X1, the valve 22 is allowed to move within a reduced range. The movement of the valve 22 allowed in the reduced range can provide a valve open/closed state suitable for a relatively low speed operation of the internal combustion engine. When the cam shaft 26 is moved in the direction X2, the valve 22 is allowed to move within an increased range. The movement of the valve 22 allowed in the increased range can provide a valve open/closed state suitable for a relatively high speed operation of the internal combustion engine.

A description will now be given of a specific operation of the valve driving apparatus 20.

As has been described previously, the cam vertical line A passing through the shaft center G of the three-dimensional cam 21 is positioned so as to be offset by distance $_{\Delta}E$ towards the upstream side in the rotational direction of the three-dimensional cam 21 with respect to the lifter axis D. Hence, the contact position S between the three-dimensional cam 21 and the shim 24 is located on the downstream side with respect to the cam vertical line A in the rotational direction of the three-dimensional cam 21 in the state in which the circular base 25*a* of the three-dimesnional cam 21 is in contact with the shim 24.

Since the contact position S between the cam 21 and the shim 24, that is, the point at which the cam 21 pushes the shim 24, deviates from the cam vertical line A, a moment (rotational force) is exerted on the shim 24. The moment exerted on the shim 24 urges the shim 24 so that the shim 24 can be rotated. It should be noted that the spherical recess portion 32 of the lifter 23 and the spherical projection portion 34 of the shim 24 have an identical radius and thus the shim 24 is allowed to freely move on the lifter 23.

The extension portion 35 of the lifter 23 and the flange portion 36 of the shim 24 are allowed to contact each other. The shim 24 urged by the rotational moment is rotated on the lifter 23, and the flange portion 36 of the shim 24 is partially in contact with the extension portion 35 of the lifter 23. That is, the positional relationship among the cam 21, the lifter 23 and the shim 24 functions as a shim urging mechanism which urges the shim 24 so that the flange portion 36 of the shim 24 is always in contact with a part of the extension part 35 of the lifter 23.

With the above structure, it is possible to realize that the flange portion 36 of the shim 24 is always in contact with the lifter 23. Hence, even if the shim 24 is moved by a rotation of the three-dimensional cam 21, the flange portion 36 can be prevented from hitting the lifter 23 and occurrence of a noisy impact sound can be prevented.

A further description will be given, with reference to FIGS. 3 and 4, of the operation of the valve driving apparatus 20.

In a state shown in parts (A) of FIGS. 3 and 4, the shim 24 is in contact with the circular base 25*a* of the cam 21 (the turning angle is equal to 0°). In the above state, the flange portion 36 is in contact with the lifter 23 at a position indicated by an arrow TA shown in part (A) of FIG. 3. In a state shown in parts (B) of FIGS. 3 and 4 (at a turning angle of 30°), the shim 24 is in contact with a boundary portion between the circular base 25*a* and the cam lobe 25*b*. In this state, the flange 36 is in contact with the lifter 23 at a position indicated by an arrow TB shown in part (B) of FIG. 3.

In a state shown in parts (C) of FIGS. 3 and 4 (at a turning angle of 60°), the shim 24 is in contact with the side portion of the cam lobe 25*b*. In this state, the flange 36 is in contact with the lifter at a position indicated by an arrow TC shown in part (C) of FIG. 4. In a state shown in parts (D) of FIGS. 3 and 4 (at a turning angle of 90°), the shim 24 is in contact with the top portion of the cam lobe 25*b*. In this state, the flange 36 is in contact with the lifter 23 at a position indicated by an arrow TD shown in part (D) of FIG. 4.

In a state shown in parts (E) of FIGS. 3 and 4 (at a turning angle of 120°), the shim 24 is in contact with the side portion of the cam lobe 25*b*. In this state, the flange 36 is in contact with the lifter 23 at a position indicated by an arrow TE shown in part (E) of FIG. 4. In a state shown in parts (F) of FIGS. 3 and 4 (at a turning angle of 150°), the shim 24 is in contact with the boundary portion between the circular base 25*a* and the cam lobe 25*b*. In this state, the flange 36 is in contact with the lifter 23 at a position indicated by an arrow TF shown in part (F) of FIG. 3.

In a state shown in parts (G) of FIGS. 3 and 4 (at a turning angle of 180°), the shim 24 is in contact with the circular base 25*a* of the cam 21. In this state, the flange 36 is in contact with the lifter 23 at a position indicated by an arrow TG shown in part (G) of FIG. 3.

Although not shown for the sake of convenience, the shim 24 is maintained, when the turning angle falls in the range of 180° to 360°, in states in which the shim 24 is in contact with the circular base 25*a* of the cam 21, that is, the states shown in parts (A) and (G) of FIGS. 3 and 4. Hence, the flange 36 is in contact with the lifter 23 when the turning angle of the cam 21 falls in the range of 180° to 360°.

It can be seen from FIGS. 3 and 4 that the arrangement of the cam vertical line A which passes through the center G of the shaft of the cam 21 and is offset towards the upstream side in the rotational direction of the cam 21 with respect to the lifter axis D causes the flange 36 to be in contact with the lifter 23. That is, even if the shim 24 is rotated by a rotation of the cam 21, a part of the shim 24 is always in contact with the lifter 23. Hence, even if the shim 24 is moved by a rotation of the cam 21, the flange 36 can be prevented from a new contact with the lifter 23, and occurrence of a noisy impact sound can be prevented.

It should be noted that the contact position at which the shim 24 is partially in contact with the lifter 23 moves in accordance with rotation of the cam 21. Hence, it is possible to prevent the lifter 23 and/or shim 24 from being unevenly worn.

Figure 5:
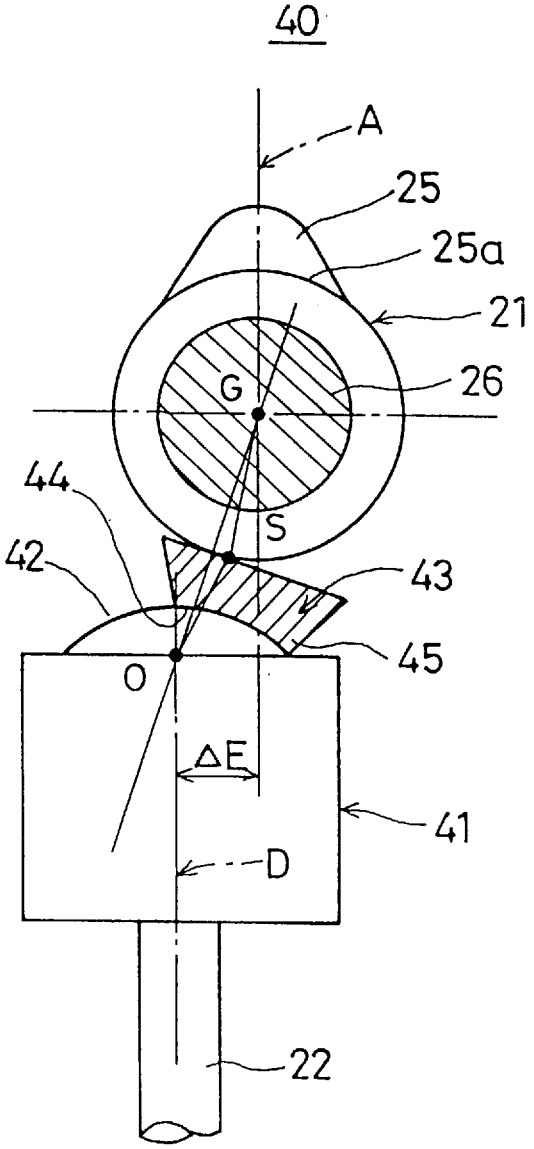
FIG. 5 is a partial cross-sectional side view of a valve driving apparatus according to a second embodiment of the present invention.

A description will now be given of a valve driving apparatus 40 according to a second embodiment of the present invention with reference to FIG. 5, in which parts that are the same as those shown in the previously described figures are given the same reference numbers.

In the above-mentioned first embodiment of the present invention, the spherical recess portion 32 is formed on the top surface of the lifter 23, and the spherical projection portion 34 is formed in the lower portion of the shim 24. Further, the portions 32 and 34 have the spherical surfaces each having the radius R with the common center O.

In the valve driving apparatus 40 according to the second embodiment of the present invention, a spherical projection portion 42 is formed on a top surface of a lifter 41, and a spherical recess portion 44 is formed in a lower part of a shim 43. The portions 42 and 44 have spherical surfaces each having the radius R having the common center O. Hence, the shim 43 is allowed to freely move on the lifter 41.

The second embodiment of the present invention employs the offset arrangement of the cam vertical line A in the same manner as the first embodiment thereof. That is, the cam vertical line A which passes through the center G of the shaft of the cam 21 and is offset by $_{\Delta}$E towards the upstream side in the rotational direction of the cam 21 with respect to the lifter axis D causes the flange 36 to be in contact with the lifter 23. Hence, the contact position S at which the cam 21 and the shim 43 are in contact with each other is positioned on the downstream side in the rotational direction of the cam 21 with respect to the cam vertical line A.

With the above structure, a rotational moment (rotational force) is exerted on the shim 43 as in the case of the valve driving apparatus 20 according to the first embodiment of the present invention. The shim 43 is urged by the rotational moment exerted thereon and is rotated on the lifter 41. Hence, a circumferential lower portion 45 of the shim 43 is always in contact with the lifter 41. Hence, the cam 21, the lifter 41 and the shim 43 function as a shim urging mechanism which causes the circumferential lower portion 45 of the shim 43 to be in contact with the lifter 41.

Thus, the shim 43 is maintained in the state in which the shim 43 is in contact with the lifter 41. Hence, even if the shim 43 is moved by rotation of the cam 21, the circumferential lower portion 45 of the shim 43 is always in contact with the lifter 41, so that a noisy impact sound does not occur.

Figure 6B:
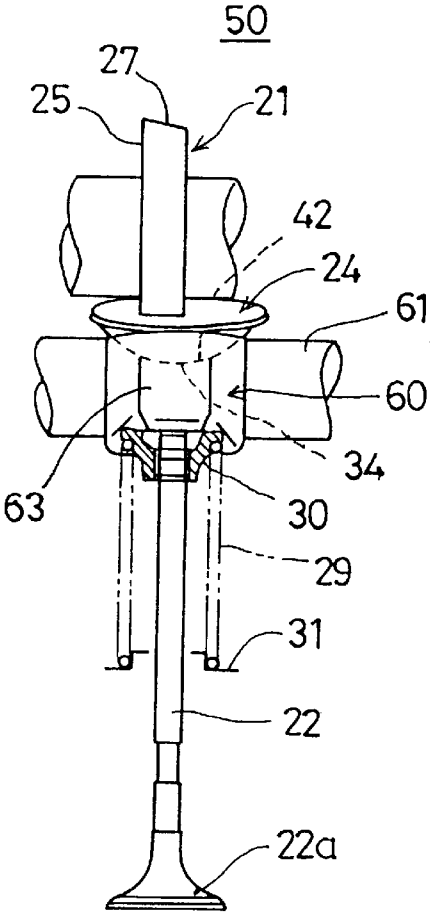
FIGS. 6A and 6B are partial cross-sectional side views of a valve driving apparatus according to a third embodiment of the present invention.
Figure 6A:
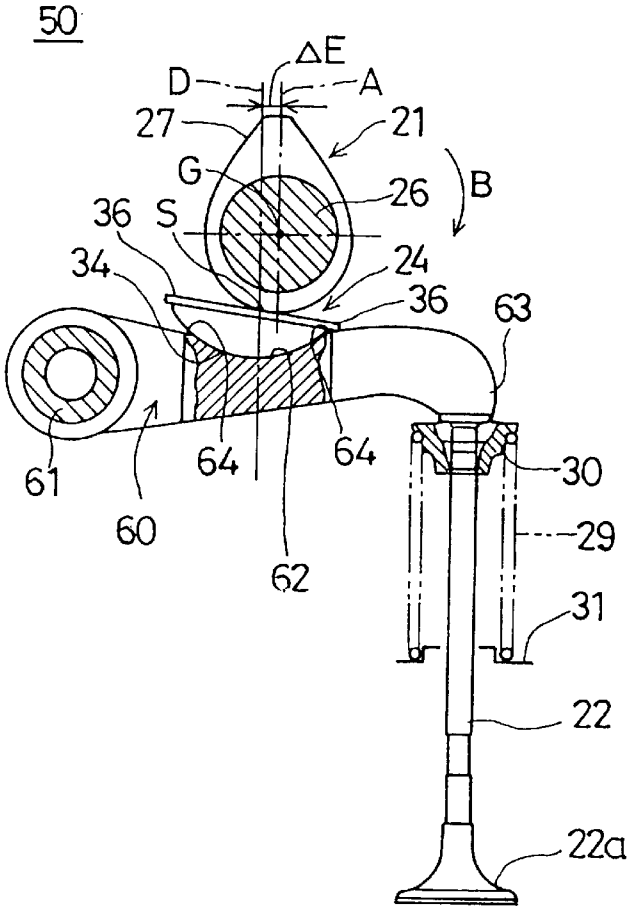

A description will now be given of a valve driving apparatus 50 according to a third embodiment of the present invention with reference to FIGS. 6A and 6B, in which those parts that are the same as those shown in the previously described figures are given the same reference numbers. The valve driving apparatus 50 has an arrangement in which a rocker arm 60 is provided as a force transfer member which transfers the force of the cam 21 to the valve 22.

The rocker arm 60 has one end which is rotatably supported by a rocker shaft 61, and another end in which an operation portion 63 is formed and is in contact with the upper end portion of the valve 22. A spherical recess portion 62 is integrally formed in an intermediate portion of the rocker arm 60 located between the rocker shaft 61 and the operation portion 63. The shim 24 is provided to the spherical recess portion 62.

The three-dimensional cam 21 is provided to the upper portion of the shim 24, and is rotated by a rotation of the cam shaft 26, so that the shim 24 can be pressed and urged. At this time, the shim 24 is displaced by the rocker shaft 61. The spherical recess portion 62 formed in the rocker arm 60 has the same structure as that of the spherical recess portion 32 of the first embodiment of the present invention.

That is, the cam vertical line A which passes through the center G of the shaft of the cam 21 is offset by $_{\Delta}$E towards the upstream side in the rotational direction of the cam 21 with respect to the lifter axis D passing through the center of the spherical recess portion 62 of the rocker arm 60. Hence, in the state in which the circular base 25*a* of the cam 21 is in contact with the shim 24, the contact position S at which the cam 21 and the shim 24 are in contact with each other is positioned on the downstream side in the rotational direction of the cam 21 with respect to the cam vertical line A. Hence, the contact position S at which the cam 21 presses the shim 24 deviates from the cam vertical line A, so that a moment (rotational force) is exerted on the shim 24. Hence, the shim 24 is urged by the moment and is rotated on the rocker arm 60.

A portion 64 is formed on the upper end portion of the spherical recess portion 62 provided in the rocker arm 60. The flange 36 is formed in the circumferential portion of the shim 24, and is in contact with the portion 64. Hence, a part of the flange 36 is always in contact with the portion 64 of the rocker arm 60 while the shim 24 is urged by the rotational moment and is thus rotated on the rocker arm 60. Thus, the cam 21, the shim 24 and the rocker arm 60 having the particular positional relationship functions as a shim urging mechanism which urges the shim 24 so that the flange 36 is always in contact with the rocker arm 60. Thus, even if the shim 24 is moved by a rotation of the cam 21, the flange 36 can be prevented from a new contact with the rocker arm 60, and occurrence of a noisy impact sound can be prevented.

It should be noted that the contact position at which the shim 24 is partially in contact with the rocker arm 60 moves in accordance with a rotation of the cam 21. Hence, it is possible to prevent the rocker arm 60 and/or shim 24 from being unevenly worn.

The above-mentioned first through third embodiments of the present invention are of the direct moving (or overhead cam) type or the rocker arm type. However, the present invention is not limited to these types, and includes other types of a valve driving apparatus, such as a swing arm type apparatus. Further, the present invention can be applied to a mechanism using a valve other than an internal combustion engine.

The present invention is not limited to the specifically disclosed embodiments, and variations and modifications may be made without departing from the scope of the present invention.

What is claimed is:

1. A valve driving apparatus comprising:

a cam;

a force transfer member transferring force from the cam to a valve; and a shim interposed between the cam and the force transfer member and movable on the force transfer member, the shim including a flange extending radially outward from an outer circumference thereof, wherein the flange is always in contact with the force transfer member while the shim is being moved on the force transfer member in accordance with a motion of the cam.

2. The valve driving apparatus as claimed in claim 1, wherein the flange is always in contact with a circumferential rim of the force transfer member while the shim is being moved on the force transfer member.

3. The valve driving apparatus as claimed in claim 1, wherein:

the shim has a spherical projection portion; and the force transfer member has a spherical recess portion which engages with the spherical projection portion.

4. The valve driving apparatus as claimed in claim 3, wherein the flange forms a flat surface.

5. The valve driving apparatus as claimed in claim 2, wherein the cam has a center which is offset from an axis of the force transfer member.

6. The valve driving apparatus as claimed in claim 5, wherein the center of the cam is offset from the axis of the force transfer member by a predetermined distance in a direction substantially opposite a direction of tangential movement of a portion of the cam currently in contact with the shim.

7. The valve driving apparatus as claimed in claim 1, wherein the valve is provided in an internal combustion engine.

8. A valve driving apparatus comprising:

a cam having a center which is offset from an axis of the force transfer member by a predetermined distance;

a force transfer member transferring force from the cam to a valve; and a shim interposed between the cam and the force transfer member and movable on the force transfer member, wherein a circumferential rim of the shim is always in contact with the force transfer member while the shim is being moved on the force transfer member in accordance with a motion of the cam, wherein the center of the cam is offset in a direction substantially opposite a direction of tangential movement of a portion of the cam currently in contact with the shim.

9. The valve driving apparatus as claimed in claim 8, wherein:

the shim has a spherical recess portion; and the force transfer member has a spherical projection portion which engages with the spherical recess portion.

10. The valve driving apparatus as claimed in claim 9, wherein the cam has a center which is offset from an axis of the force transfer member.

* * * * *